United States Patent [19]

Mente et al.

[11] Patent Number: 4,964,197

[45] Date of Patent: Oct. 23, 1990

[54] APPARATUS FOR THE PRODUCTION OF NON-WOVEN MATERIAL FROM ENDLESS FILAMENTS

[75] Inventors: Kurt Mente, Hannover; Gerhard Knitsch, Wedemark, both of Fed. Rep. of Germany

[73] Assignee: J.H. Benecke AG and Corovin GmbH, Hannover Peine, Fed. Rep. of Germany

[21] Appl. No.: 340,068

[22] Filed: Apr. 18, 1989

Related U.S. Application Data

[62] Division of Ser. No. 932,889, Nov. 20, 1986, Pat. No. 4,847,035.

[30] Foreign Application Priority Data

Nov. 21, 1985 [DE] Fed. Rep. of Germany ..... 35411287

[51] Int. Cl.[5] ..... D01G 25/00

[52] U.S. Cl. ..... 19/299; 19/296; 264/555

[58] Field of Search ..... 19/299, 296; 264/555; 226/97; 156/167

[56] References Cited

U.S. PATENT DOCUMENTS

| | | | |
|---|---|---|---|
| 3,094,262 | 6/1963 | Ashby et al. | 226/97 |
| 3,485,428 | 12/1969 | Jackson | 19/299 |
| 3,655,862 | 4/1972 | Dorschner et al. | 226/97 |
| 3,734,803 | 5/1973 | Lipscomb et al. | 19/299 |
| 3,736,211 | 5/1973 | Lipscomb et al. | 19/299 |
| 3,776,796 | 12/1973 | Lipscomb et al. | 19/299 |
| 4,322,027 | 3/1982 | Reba | 19/299 |
| 4,346,504 | 8/1982 | Birk et al. | 19/299 |

*Primary Examiner*—Werner H. Schroeder
*Assistant Examiner*—Michael A. Neas
*Attorney, Agent, or Firm*—Cushman, Darby & Cushman

[57] ABSTRACT

To produce non-woven materials, endless filaments in the form of a warp are drawn off a filament draw-off nozzle to which are joined a filament offlet, a filament guide tube and a spreading extruder. An amount of compressed air under high pressure is admitted to the filament draw-off nozzle. By means of the invention the amount of compressed air at the filament draw-off nozzle is reduced and at the same time an additional amount of compressed air under relatively low pressure is admitted between the filament guide tube and the spreading extruder by means of a propelling nozzle. In spite of an additional amount of compressed air at the propelling nozzle the reduction at the filament draw-off nozzle is so large that for the isothermal compression output as a whole a considerable savings in energy of almost 30% can be achieved, and this while maintaining the important filament draw-off force necessary for the drawing of the filaments inside the filament offlet. In addition, the additional compressed air also permits an improved, more even distribution (spreading) of the warp at the exit of the spreading extruder, whereby the quality of the non-woven material is improved.

11 Claims, 2 Drawing Sheets

APPARATUS FOR THE PRODUCTION OF NON-WOVEN MATERIAL FROM ENDLESS FILAMENTS

This is a division of application Ser. No. 06/932,889, filed Nov. 20, 1986 now U.S. Pat. No. 4,847,035.

BACKGROUND OF THE INVENTION

The invention relates to a process for the production of non-woven material from endless filaments which are drawn off from spinnerets in the form of a warp by means of a gaseous propellant and are deposited, after moving through a tube-like filament draw-off device, on a substrate for the formation of the non-woven material. To obtain a desired filament draw-off force, the gaseous propellant is supplied to a filament draw-off nozzle, located at the input side of the filament draw-off device, with a set input pressure (compressed air pressure) and with a set input volume (amount of compressed air). Furthermore, the invention relates to an apparatus for the carrying out of the process.

Processes and apparatus of the species mentioned above are known from German patent 1 785 158, British patent 1 282 176 and British patent 1 297 582. There a warp coming from a liquefied material and through spinnerets is guided through a filament draw-off device having a filament draw-off nozzle at its upper end. The latter is fed with highly compressed air.

The so-called Lavalle enlargement adjoins the narrowest annular slit of the filament draw-off nozzle at the exit of which low pressure is generated. This low pressure then also occurs via a small inner filament-guide at the input side of the filament draw-off nozzle and makes possible the threading of the warp.

A filament offlet with an inner diameter of the Lavalle enlargement adjoins the Lavelle enlargement, into which air flows at supersonic speed. After about half the distance of the filament offlet of a total length of approximately 250 mm a compression shock with following subsonic flow occurs, which further slows inside the adjoining filament guide tube having a four- to six-fold diameter.

Within the filament draw-off device consisting of the filament offlet and the filament guide tube the drawing of the filaments takes place, which thereby become thinner. A substantial part of the filament draw-off force is provided by the filament offlet. The object of the filament guide tube is only to transport the warp to a spreading extruder and, if required, to so-called Coanda shells, in order to distribute the filaments evenly and to spread them before they are deposited on a substrate for the formation of the non-woven material.

It is customary for obtaining large-area widths of non-woven material to dispose a plurality of filament draw-off devices side-by-side, wherein the separate draw-off nozzles are in each case fed with highly compressed air as the gaseous propellant. The process this far known and described, although effective in practical use, is nevertheless not free of disadvantages. The compressed air energy necessary for drawing of the filaments represents a considerable cost factor which inevitably is reflected in the end price of the non-woven material.

Even though it could be considered to diminish the cost factor for the energy needed by reducing the compressed air energy, this measure cannot be taken, since then the required filament draw-off force and the required drawing for the production of a perfect non-woven material are no longer available. For this reason, highly compressed air has to be relied on to obtain an optimal filament draw-off force and an optimal drawing.

SUMMARY OF THE INVENTION

Here the invention takes over, having as an object the setting up of a process making possible a reduction in cost regarding the required energy while retaining the required filament draw-off force. Furthermore, by means of the invention an apparatus for the carrying out of such a process is to be provided.

To achieve this object it is provided in the process described in the preamble of claim 1 to supply in the area of the exit of the filament draw-off device a gaseous propellant with reduced pressure and volume by means of an additional propelling nozzle and, at the same time, to reduce the input pressure and the input volume.

Therefore the invention takes the surprising step of additionally providing a propelling nozzle for the admission of compressed air energy. Although apparently this leads to additional cost, the invention is based on the recognition that, at the same time, a reduction of the compressed air energy supplied to the filament draw-off nozzle can be effected while retaining the original filament draw-off force. The energy savings at the filament draw-off nozzle are thereby greater than the additional energy required at the propelling nozzle, so that an overall energy and cost savings can be achieved. It was noted during tests that a considerable savings in energy of at least almost 30% could be obtained. Another important advantage of the invention lies in the fact that this energy savings can be achieved by the apparatus in a simple way using only one component—namely a propelling nozzle—between the lower end of the filament guide tube and the spreading extruder.

For a better understanding of the invention exemplary figures are given below which were obtained from a test arrangement, and it should be noted that the test arrangement refers to the known process presupposed in the beginning. Measured were the filament draw-off force—determined with a copper wire of 0.13 mm thickness—of a customary filament draw-off nozzle with the narrowest diameter or annular slit of 5 mm and with a filament offlet with a ratio of length to diameter of 43. With an amount of compressed air of $v_o=72$ $Nm^3/h$ and a compressed air pressure (nozzle admission pressure) of $p_o=21$ bar, the filament draw-off force is approximately 0.18 N (Newton). This filament draw-off force is required, for instance, if a polypropylene non-woven material having a filament titre of 2 dtex is to be produced.

The values mentioned for the compressed air volume $v_o$ and the compressed air pressure $p_o$ constitute the usually customary values and, by means of these figures and using the formula for the isothermal compression output $$N=\text{const. } \ln(p_o/p)\times v_o$$

the energy savings made possible by the invention are to be shown. With the values $v_o$ and $p_o$ mentioned, the isothermal compression output in the known process is $N=k\times 219.2$ (k being a constant; only the number value 219.2 is of importance here).

Proceeding from the above values the circumstances in regard to the invention are as follows: at the filament draw-off nozzle the amount and the pressure of the compressed air are reduced to $v_1=52.4$ $Nm^3/h$ and $p_1=16$ bar. This results in a compression output of $N_1=k\times 145.3$.

The following values are used as basis at the propelling nozzle at the lower end of the filament guide tube: $v_2=19.6$ $Nm^3/h$ and $p_2=1.9$ bar. The calculated isothermal compression output therefor is $N_2=k\times 12.6$.

As can be seen, the addition of $v_1$ and $v_2$ again results in the initially presupposed value of $v_o=72$ $Nm^3/h$. The reduction of the amount of compressed air at the filament draw-off nozzle therefore can be used for the amount of compressed air at the propelling nozzle. Important is the energy balance, because the sum of $N_1$ and $N_2=k\times 157.9$ is contrasted with the higher value of $N=k\times 219.2$, calculated above in regard to the known process and without using the invention. The result is a savings in energy of approximately 28%, while still retaining the filament draw-off force—which is an important aspect.

Based on the physical laws in regard to the isothermal compression output, the filament draw-off force, the flow-through resistance of the filament draw-off device and the requirement that an underpressure of from 0.6 to 0.8 bar should prevail at the suction orifice of the filament draw-off nozzle in order to be able to insert the warp into the filament draw-off nozzle, and further based on the requirement that the filament draw-off force for obtaining a predetermined filament titre cannot be reduced, a ratio of length to diameter of the filament draw-off tube of $l/d=80$ to 180, depending on polymer and titre, has proven effective. Moreover, the dimensions and sizes of the filament offlet can be freely selected as long as the flow-through resistance of 0.01 bar is not exceeded.

With increased flow-through resistance the pressure at the suction orifice of the filament draw-off nozzle increases unduly so that ruptured filaments—caused by faulty spots in the polymer—cannot be captured. If the filament ruptures add up, the result may be considerable disruption of the operation.

In accordance with the above example the invention makes possible a reduction of the compressed air pressure $p_1$ before the filament draw-off nozzle from 21 to 16 bar as well as a reduction of the amount of air $v_1$ from 72 to 52.4 $Nm^3/h$ while maintaining the filament draw-off force. In this case the ratio of length to diameter of the filament offlet in a practical embodiment of the invention is $l/d=110$.

The added air supplied at the propelling nozzle with simultaneous reduction of the amount of compressed air at the filament draw-off nozzle is provided according to the invention with a relatively low level of pressure of $p_2=1.9$ bar. In toto, the isothermal compression output for the amount of air at the propelling nozzle with the low admission pressure is so low that it becomes possible to obtain the considerable savings in energy described.

A further advantage of the invention consists in the fact that the propelling nozzle makes possible a shortening of the filament guide tube by which its flow-through resistance is reduced. When maintaining the total flow-through resistance of the draw-off device, the above mentioned ratio of length to diameter can be obtained by a lengthening of the filament draw-off tube.

However, this does not yet exhaust the positive effects of the propelling nozzle provided by the invention. Surprisingly it has been shown that the supply of the additional amount of compressed air under comparatively low pressure ahead of a spreading extruder provided with Coanda shells advantageously assists in a more even distribution of the warp. This increases the quality of the non-woven material—wherein an even distribution is necessary. The spread angle at the Coanda shells becomes greater with increasing amount of air, whereby the distribution of the warp becomes more even.

Further practical embodiments and advantageous improvements of the invention are recited in the subclaims and can be seen from the drawings. In the following, the invention is further described by means of the exemplary embodiment shown in the drawings.

DETAILED DESCRIPTION

Figure 1:
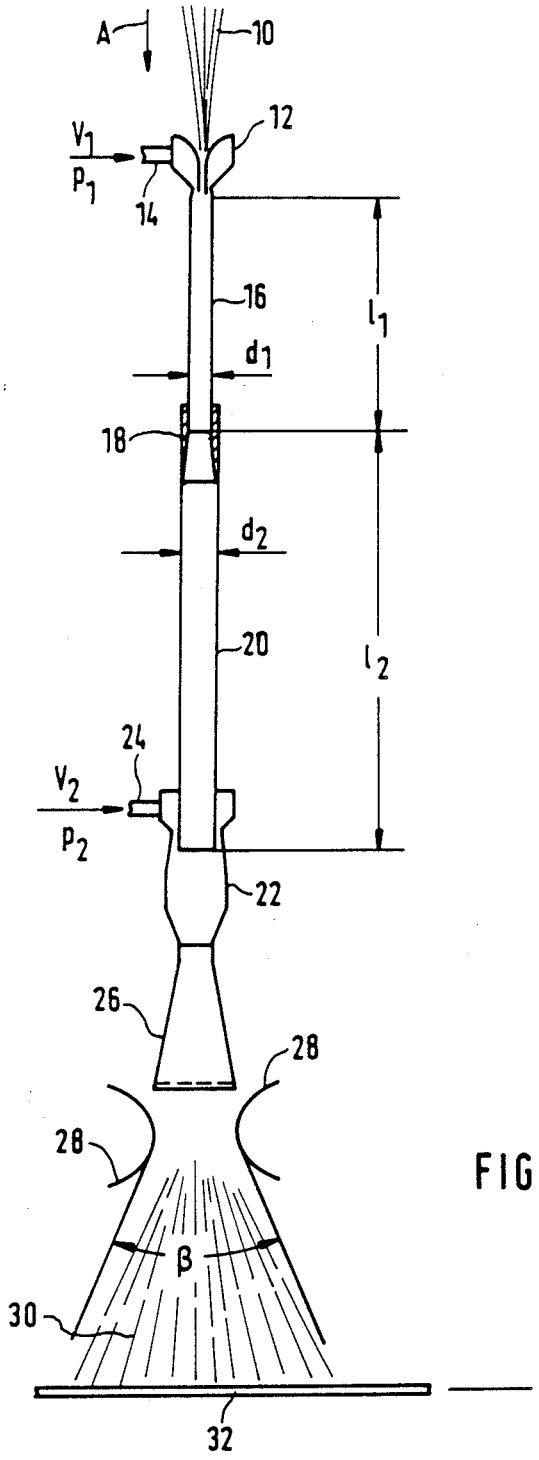
FIG. 1 is a schematic view of an apparatus for the production of a non-woven material from endless filaments.

In the apparatus shown in FIG. 1, endless filaments 10 are drawn in the direction of the arrow A by a, per se, known filament draw-off nozzle 12. The endless filaments are produced in the customary way from a liquified material and are drawn through spinnerets not shown in the drawing.

The filament draw-off nozzle 12 has a compressed air connector 14 for the supply of an amount of compressed air $v_1$ under pressure $p_1$. A filament offlet 16 adjoins the filament draw-off nozzle 12, and a filament guide tube 20 is connected via a forcing cone 18.

The endless filaments drawn off at the top emerge from the bottom of a spreading extruder 26 which is provided with Coanda shells 28. The so-called Coanda effect is used here to spread the filaments 30 before they impact on a screen conveyor 32 which is air-permeable and under vacuum, whereby the non-woven material is formed.

The filament draw-off force is mainly created in the filament offlet 16, through the first half of which air flows at supersonic speed and, after the compression shock, with subsonic speed. The filaments thus reach speeds of from 30 to 100 m/s, depending on the size of the filament titre. The flow-through resistance is kept low by means of the forcing cone 18, which has a cone angle of less than 8°. The apparatus so far described is known.

The filament guide tube 20 moves the warp to a propelling nozzle 22 provided in the novel apparatus, which is disposed between the filament guide tube 20 and the spreading extruder 26 and has a compressed air connector 24, by means of which an amount of air $v_2$ is provided under reduced pressure $p_2$. The filament guide tube 20 is of such size that the flow-through resistance is less than 0.01 bar.

Figure 2:
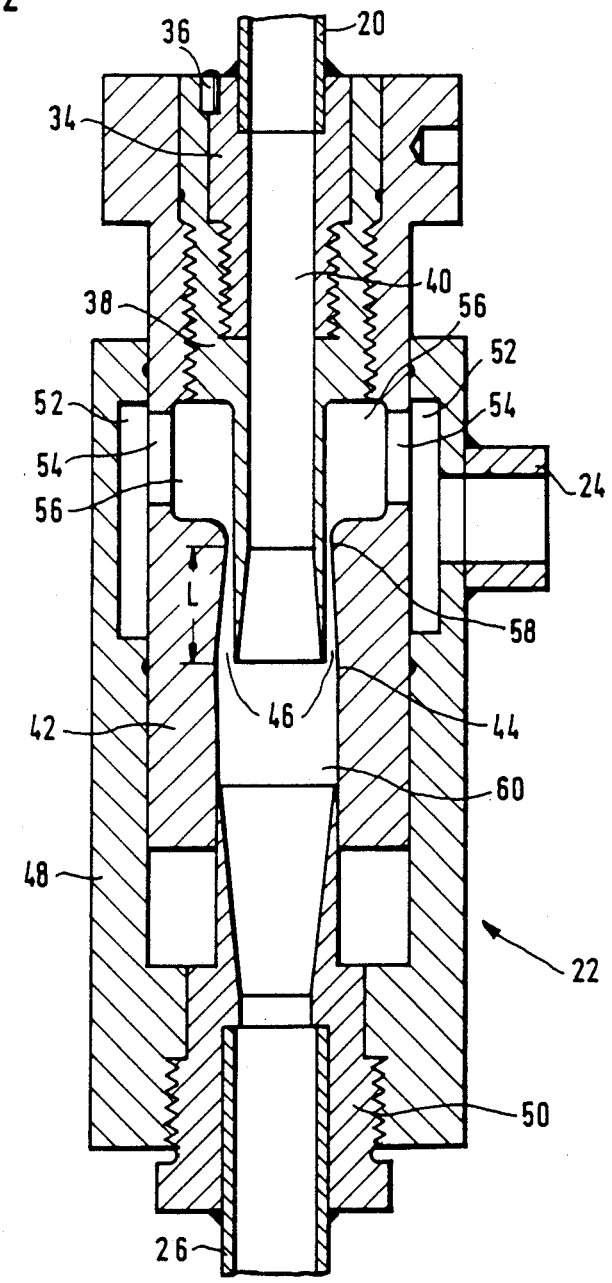
FIG. 2 is a diametrical section of a propelling nozzle.

In FIG. 2 the detailed construction of the propelling nozzle 22 is shown, which is soldered to the filament guide tube 20. The propelling nozzle 22 comprises a first threaded element 34, which is screwed onto a second threaded element 38 and is secured against torsion by a straight pin 36. The first threaded element 34 and the second threaded element 38 together comprise a tube extension 40.

Further components of the propelling nozzle 22 are a rotatable adjusting ring 42 which can be moved in axial direction by rotation, as well as a casing 48 and a cone-shaped junction element 50 which is soldered to the input side of the spreading extruder 26.

A pre-chamber 52 adjoins the compressed air connector 24 already shown in FIG. 1, and is connected with a compression chamber 56 via bores 54. The inner wall of the adjusting ring 42 forms a feeder from the compression chamber 56 to the filament guide chamber 60 in the form of a Laval enlargement 46 with an air output 44.

The narrowest cross section has been designated by the reference numeral 58 and L indicates the length of the Laval enlargement 46. To set the air pressure at the air output 44 the length L of the Laval enlargement 46 can be influenced by rotating the adjustment ring 42.

For this purpose the casing 48 as well as the first threading element 34 are axially and radially fixed. The compressed air $v_2$, $p_2$ flows through the compressed air connector 24 into the pre-chamber 52 and via the bores 54 into the compression chamber 56 and then through the narrowest cross section 58 to the air output 44 or the Laval enlargement 46. To keep the flow-through resistance of the propelling nozzle 22 low, the second threaded part 38 is conically enlarged at its end or output side and the cone-shaped junction element is conically enlarged at its input end.

In FIG. 1 the diameter of the filament offlet 16 is designated by $d_1$ and the length with $l_1$, while $d_2$ and $l_2$ indicate the diameter or the length of the filament guide tube 20. By the insertion of the propelling nozzle 22 the ratio of length to diameter can be varied.

The ratio $l_1/d_1$ is about 110 in order to obtain an optimal filament draw-off force. The filament guide tube 20 substantially determines the flow-through resistance and here the ratio $l_2/d_2$ is chosen such that the above mentioned flow-through resistance of less than 0.01 bar is the result. Within the scope of the invention other values are, of course, also possible in connection with the conditions mentioned.

What is claimed is:

1. An apparatus for producing non-woven material from endless filaments comprising:

a filament draw off nozzle for drawing off said endless filaments;

a filament offlet disposed below said filament draw off nozzle for creating a filament draw off force;

a filament guide tube disposed below said filament offlet for guiding said filaments;

a spreading extruder for spreading said filaments disposed below said filament guide tube; and a propelling nozzle disposed at an end of said filament guide tube located near said spreading extruder and oriented to direct compressed air toward said spreading extruder.

2. An apparatus according to claim 1 wherein, the propelling nozzle has an adjustable Laval enlargement.

3. An apparatus according to claim 1 wherein the propelling nozzle leads into the spreading extruder.

4. An apparatus according to claim 1 wherein the propelling nozzle is disposed between and threadably connected to the filament guide tube and the spreading extruder.

5. An apparatus according to claim 1 wherein a ratio of length to diameter (1, /d,) of the filament offlet is between 80 and 180.

6. An apparatus according to claim 1 further comprising a forcing cone located between the filament offlet and the filament guide tube.

7. An apparatus according to claim 1 wherein the propelling nozzle includes a compressed air connector, which is adjoined by a prechamber connected with a compression chamber via bores.

8. An apparatus according to claim 7 wherein the compression chamber leads, via a narrowed cross section, into a tube-like filament guide chamber to which is joined the spreading extruder.

9. An apparatus according to claim 8 wherein the filament guide chamber leads into the spreading extractor via a cone-shaped junction element.

10. An apparatus according to claim 2 wherein the propelling nozzle has an inner adjustment ring movable by rotation in an axial direction for adjusting the Laval enlargement.

11. An apparatus according to claim 1 wherein the dimensions of the filament guide tube provide a flow-through resistance of less than 0.01 bar.

* * * * *